US011788169B2

(12) United States Patent
Ribeiro et al.

(10) Patent No.: US 11,788,169 B2
(45) Date of Patent: Oct. 17, 2023

(54) DEVICE AND PROCESS FOR INHIBITING PARTICULATE EMISSION BY COOLING OF DISPLACEABLE HOT PRODUCTS USING A CONVEYOR

(71) Applicant: VALE S.A., Rio de Janeiro (BR)

(72) Inventors: Lucilio Bertoldi Ribeiro, Vitória (BR); Francisco Magalhães Fazollo, Vila Velha (BR)

(73) Assignee: VALE S.A., Rio de Janeiro (BR)

( * ) Notice: Subject to any disclaimer, the term of this patent is extended or adjusted under 35 U.S.C. 154(b) by 798 days.

(21) Appl. No.: 16/725,977

(22) Filed: Dec. 23, 2019

(65) Prior Publication Data

US 2020/0270720 A1 Aug. 27, 2020

(30) Foreign Application Priority Data

Dec. 27, 2018 (BR) ..... 10 2018 077231 7

(51) Int. Cl.
*C22B 1/26* (2006.01)

(52) U.S. Cl.
CPC ..... *C22B 1/26* (2013.01)

(58) Field of Classification Search
CPC ..... C22B 1/26
See application file for complete search history.

(56) References Cited

U.S. PATENT DOCUMENTS

| | | | | |
|---|---|---|---|---|
| 4,042,227 | A * | 8/1977 | Niehaus | C21D 1/667 134/64 R |
| 4,330,111 | A * | 5/1982 | Matsuoka | C21D 9/5732 266/107 |
| 4,722,483 | A * | 2/1988 | Saville | C21B 3/08 241/23 |
| 5,190,901 | A * | 3/1993 | Hirai | C01B 32/366 502/55 |
| 5,373,893 | A * | 12/1994 | Eisenmann | C21D 1/613 62/380 |
| 6,421,931 | B1 * | 7/2002 | Chapman | F26B 17/04 34/210 |
| 8,790,442 | B2 * | 7/2014 | Englund | C21B 11/08 75/484 |
| 2003/0019548 | A1 | 1/2003 | Miyagawa et al. | |
| 2012/0247733 | A1 * | 10/2012 | Reis et al. | C09K 3/22 165/104.19 |

FOREIGN PATENT DOCUMENTS

| | | | |
|---|---|---|---|
| CN | 204959004 | U | 1/2016 |
| JP | S60251232 | A | 12/1985 |
| WO | 2004074521 | A2 | 9/2004 |

* cited by examiner

*Primary Examiner* — Nathaniel Herzfeld
(74) *Attorney, Agent, or Firm* — ArentFox Schiff LLP

(57) ABSTRACT

This invention relates to a device for inhibiting particulate emission by cooling of displaceable hot products using a conveyor comprising a first plurality of tubular elements configured to release a first dosage of water over the products, a second plurality of tubular elements configured to release a second dosage of water over the products and wherein the first dosage released by the first plurality of tubular elements is greater than the second dosage released by the second plurality of tubular elements. This invention also relates to a process for inhibiting particulate emission by cooling displaceable hot products using a conveyor.

16 Claims, 3 Drawing Sheets

DEVICE AND PROCESS FOR INHIBITING PARTICULATE EMISSION BY COOLING OF DISPLACEABLE HOT PRODUCTS USING A CONVEYOR

CLAIM OF PRIORITY

This application claims priority to Brazilian Patent Application No. BR 10 2018 077231 7 filed Dec. 27, 2018. The disclosure of the priority application is hereby incorporated by reference in its entirety.

TECHNICAL FIELD

This invention relates to the field of treatment of iron ore agglomerates. More specifically, this invention relates to a device and a process for inhibiting particulate emission by cooling of displaceable hot products using a conveyor.

DESCRIPTION OF THE STATE OF THE ART

The use of iron ore agglomeration processes, in particular pelletizing, has intensified in recent years. The pelletizing process takes advantage of fine and ultrafine ores, which are not suitable for direct use in blast furnaces and direct reduction electric furnaces, by agglomerating them into medium diameter spheres, usually in the range of 8 to 18 mm, with chemical, physical and metallurgical properties suitable for use in the steel industry.

In order to ensure strength (compression) to the pellet, the pelletizing process has a burning phase that sinters the ores, binders and fluxes. At that phase, the pellets reach temperatures above 1,300° C. Still in the pelletizing plants, part of the heat is recovered in the cooling phases. However, since not all heat is recovered, pellet temperatures around 200° C. are commonly observed at the outlet of the plants.

Subsequent cooling steps using water and applying particulate emission inhibitors are usually employed to minimize emissions of such particulates.

In addition, water spraying on ore piles and agglomerates to control particulate emission and humidification of burnt pellets is also widespread in situations where these products are stored in open stockyards.

Accordingly, documents WO2004074521 (A2), CN204959004 (U), US2003019548 (A1) and JPS60251232 (A) disclose processes for cooling displaceable products conventionally employed in the state of the art.

Document WO2004074521 (A2) discloses a conveyor of hot material, for example pellets, consisting of a transportation means which at least in part of its longitudinal projection is covered by a housing and which is coupled to a material inlet, whereas the housing covering the transportation means is provided with inlet devices for applying water to the hot material positioned in the transportation means, wherein the intake devices are disposed exclusively in a segment of the intended transportation means distanced from the material inlet in the transport direction, and a suction device is coupled to the material inlet for aspirating the water vapor generated by the water inlet. It is disclosed that the positioning of the intake devices away from the material inlet prevents high temperature gradients in the hot material superficially cooled, thus preventing cracking in these materials. However, this document does not explain the cooling of the lower layers of material and the side region of the transportation means, nor the use of variable water flows in relation to the position of the intake devices.

Document CN204959004 (U) discloses a device for fast cooling of high temperature iron ore materials such as pellets, comprising a cooling water supply device, a water-atomizing device and a water jet device. Water is released uniformly over the material in the transportation direction, performing predominantly surface cooling. Such jet device is installed above a conveyor belt, parallel to its center, in the direction of movement, and includes a distribution tube and a plurality of jets comprising duck nozzles. However, this document does not disclose that the flow of water from the jets varies in relation to the position of each of these jets, nor does it make explicit the release of water into the side region of the conveyor.

Document US2003019548 (A1) discloses a method for cooling hot-reduced iron briquettes which includes a step of primary cooling the iron briquettes hot-reduced with steam at a cooling rate of 4.0° C./s or less, a step of secondary cooling the iron briquettes reduced with steam and sprayed water at a cooling rate of 4.0° C./s or less and a step of final cooling the iron briquettes reduced with sprayed water at a cooling rate of 3.5° C./s or more at a temperature within the temperature range of the final product. Steam generated by evaporation of sprayed water during the step of final cooling is used in the step of primary and/or secondary cooling. It is emphasized that the cooling disclosed by this document occurs through the superficial layers of iron briquettes and that the water is released in the transportation direction. This type of material generally has granulometry between 25 and 50 mm, which is substantially larger than the typical pellet granulometry (between 8 and 18 mm) In addition, since iron briquette is traditionally pressed, it has a porosity usually lower than the pellet porosity, thus retaining less water and allowing water to reach the bottom layers more easily.

Document JPS60251232 (A) discloses a device for cooling a conveyor that transports sintered ore comprising a plurality of spray jets with duck nozzles, located on the conveyor belt and driven after temperature measurement of the sintered ore. The spray jets are arranged transversely to the direction of the belt, in order to cover the entire surface of the conveyor belt. The device disclosed by this document is positioned at the belt return and is intended for belt cleaning and maintenance. This document does not disclose the cooling and/or wetting of the material load carried by the belt. Furthermore, this document does not disclose the use of variable water flows in relation to the position of each of these jets, nor does it make explicit the release of water into the side region of the belt.

Thus, there is a need for a device and process for the cooling of hot products, such as pellets and other agglomerates, which enables the efficient humidification and cooling of all product layers arranged on a conveyor in order to minimize particulate emissions for environmental control.

SUMMARY OF THE INVENTION

The invention relates to a device and a process for inhibiting particulate emission by cooling of displaceable hot products using a conveyor that enable the efficient humidification and cooling of all product layers disposed on the conveyor, minimizing particulate emissions and reducing the consumption of water.

This invention discloses a device for inhibiting particulate emission by cooling of displaceable hot products using a conveyor comprising a first plurality of tubular elements configured to release a first dosage of water over the products, a second plurality of tubular elements configured to release a second dosage of water over the products and wherein the first dosage released by the first plurality of tubular elements is greater than the second dosage released by the second plurality of tubular elements.

This invention also discloses a process for inhibiting particulate emission by cooling displaceable hot products using a conveyor.

BRIEF DESCRIPTION OF THE FIGURES

The figures are briefly described as shown below.

DETAILED DESCRIPTION

This invention relates to a device (manifold) and a process for inhibiting particulate emission by cooling displaceable hot products using a conveyor.

The device of this invention is provided with tubular elements that release water over the displaceable hot products by means of a conveyor, efficiently humidifying all the layers of hot product disposed on the conveyor to provide environmental control of particulate emissions with water quantities lower than those required by conventional systems with surface water application.

To this end, in the device of this invention, the flow of water released by the tubular elements varies along a cross section of the conveyor according to the tray height of hot product over the conveyor.

Figure 1A:
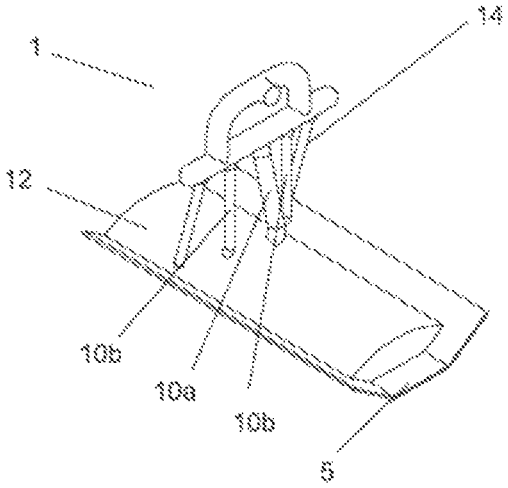
FIG. 1—views of a device for inhibiting particulate emission by cooling displaceable hot products using a conveyor: (a) perspective schematic view of the device mounted above a conveyor; (b) photograph of the device releasing water over a conveyor; (c) schematic front view of the device.
Figure 1B:
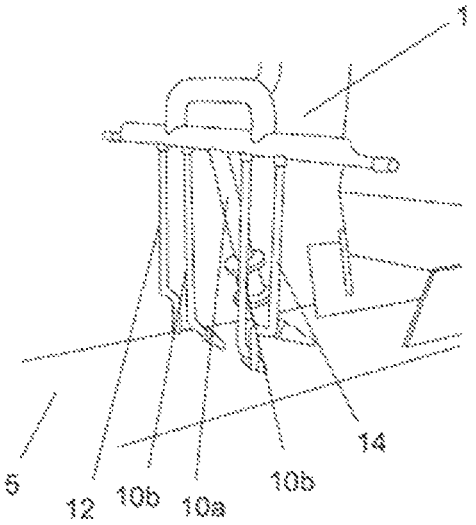
Figure 1C:
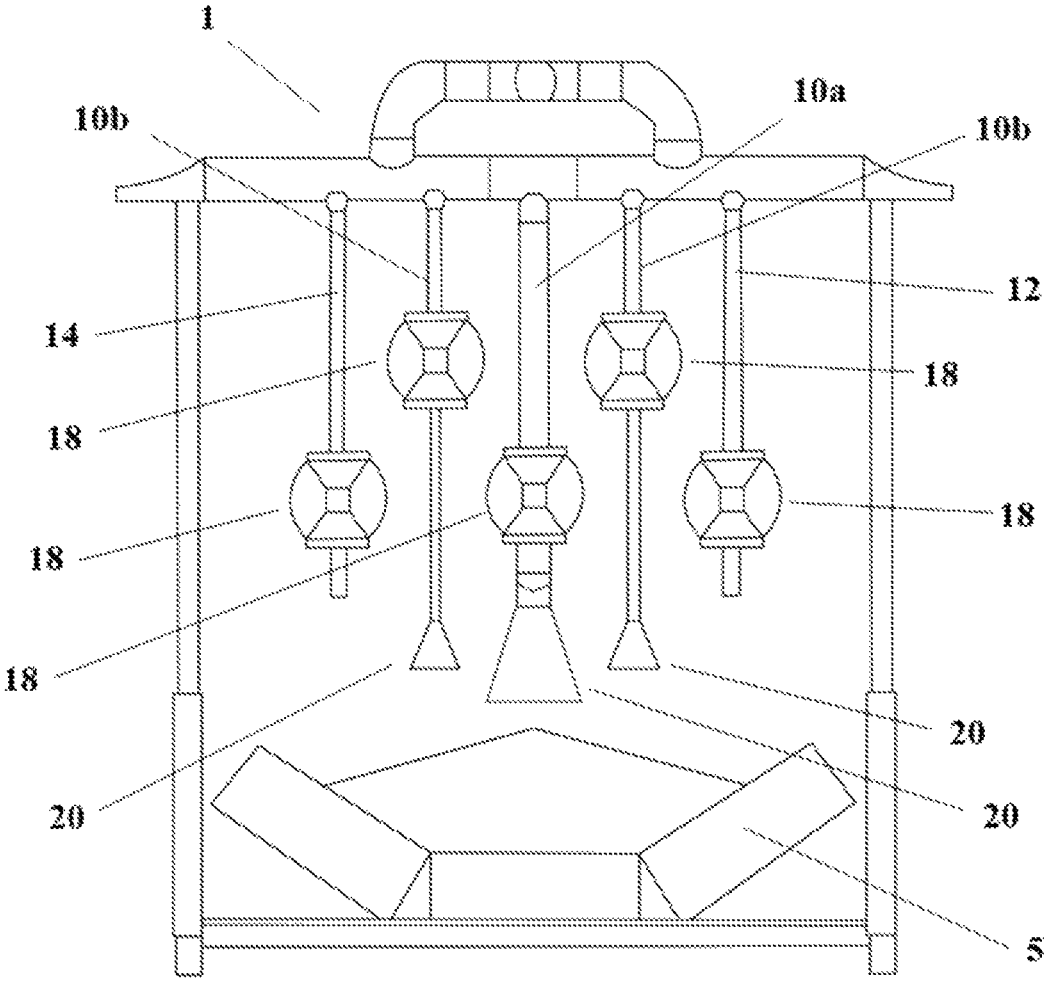

FIGS. 1(*a*), (*b*) and (*c*) illustrate the preferred embodiment of the device of this invention wherein a device 1 for inhibiting particulate emission by cooling displaceable hot products using a conveyor 5 comprises a first plurality of tubular elements 10*a*, 10*b* configured to release a first dosage of water over the hot products, a second plurality of tubular elements 12, 14 configured to release a second dosage of water over the hot products or over the side regions of the conveyor 5.

In order to achieve efficient humidification with low water consumption in the various hot product layers arranged on the conveyor 5, the device 1 is configured so that the first dosage released by the first plurality of tubular elements 10*a*, 10*b* is greater than the second dosage released by the second plurality of tubular elements 12, 14.

The first and second dosages can be determined by sizing the tubular elements 10*a*, 10*b*, 12, 14. Additionally, each tubular element of the first and second pluralities 10*a*, 10*b*, 12, 14 can comprise a valve 18 to provide a fine adjustment of the flow of water released by each of these tubular elements 10*a*, 10*b*, 12, 14.

The first plurality of tubular elements can comprise two to four tubular elements 10*a*, 10*b*. The first plurality of tubular elements preferably comprises three tubular elements 10*a*, 10*b*.

In addition, the first plurality of tubular elements 10*a*, 10*b* can be configured to release the first dosage of water over a central region of the conveyor 5, in the direction of flow of the displaceable product or, preferably, in the opposite direction of flow of hot products, providing greater cooling efficiency. To this end, the first plurality of tubular elements 10*a*, 10*b* can be arranged in a central region of the device 1 and each tubular element of the first plurality of tubular elements 10*a*, 10*b* can comprise a duck nozzle 20.

Furthermore, the second plurality of tubular elements can comprise two to four tubular elements 12, 14 and, preferably, comprises two tubular elements 12, 14. The second plurality of tubular elements 12, 14 is further configured to release the second dosage of water over the side regions of the conveyor 5.

The second plurality of tubular elements 12, 14 of device 1 can comprise a tubular element 12 disposed at a first side end of device 1 and another tubular element 14 disposed at a second side end of device 1. In order to cool the side regions of conveyor 5 and the layers of hot product at the bottom of conveyor 5, the tubular elements of the second plurality of tubular elements 12, 14 release the dosages of water over the respective side regions of conveyor 5. Preferably, there is a regular distribution of hot products on conveyor 5 and the dosages of water released by the tubular elements of the second plurality of tubular elements 12, 14 are equal. However, the dosages of water can be regulated by adjusting each of the tubular elements 10*a*, 10*b*, 12, 14 or each of the valves 18 in order to, for example, treat irregular distributions of hot products disposed on conveyor 5.

Thus, the device of this invention supplies the dosed water by only one point. Advantageously, this makes device cleaning and maintenance processes easier and faster, and investments in device deployment are significantly reduced.

The process for inhibiting particulate emission by cooling displaceable hot products using a conveyor 5 of this invention utilizes a device 1 having tubular elements 10*a*, 10*b*, 12, 14 to release water over hot products, efficiently humidifying all product layers arranged on conveyor 5 to provide environmental control of particulate emissions.

For carrying out this process, device 1 is arranged in a position transverse to the direction of travel of conveyor 5. Thus, the flow of water released by the tubular elements of the device varies along the cross section of conveyor 5 according to the tray height of hot product.

The process of this invention comprises releasing a first dosage of water over the hot products by means of a first plurality of tubular elements 10*a*, 10*b* and releasing a second dosage of water over the hot products by means of a second plurality of tubular elements 12, 14 and wherein the first dosage released by the first plurality of tubular elements 10*a*, 10*b* is greater than the second dosage released by the second plurality of tubular elements 12, 14.

The steps of releasing a first dosage of water and releasing a second dosage of water over hot products can occur concomitantly.

In the process of this invention, the first dosage of water can be from 75 to 90% of a total dosage of added water and the second dosage of water can be from 10 to 25% of the total dosage of water, wherein preferably the first dosage of water is 80% and the second dosage of water is 20%.

In this preferred embodiment, the first plurality of tubular elements 10*a*, 10*b* of device 1 preferably comprises three tubular elements 10*a*, 10*b*. For example, the first dosage can be fractionated into a 60% portion of the total dosage, which is released by the tubular element 10*a* located in the center of device 1, and into two 10% portions of the total dosage, which are released by each tubular element 10*b* adjacent the central tubular element 10*a*, and the second dosage can be fractionated into two 10% portions of the total dosage, which are released by each of the tubular elements 12, 14 located at the ends of device 1.

In the process of this invention, the first dosage of water can be released over a central region of conveyor 5 so as to predominantly perform the surface cooling of the hot products. The release of the first dosage can also be made in a direction contrary to the flow direction of the hot products by the first plurality of tubular elements 10*a*, 10*b*, providing the process with greater cooling efficiency.

In addition, the second dosage of water can be released over the side regions of conveyor 5 by means of the second plurality of tubular elements 12, 14. To this end, the second plurality of tubular elements 12, 14 can comprise a tubular element 12 disposed at a first side end of the device and another tubular element 14 disposed at a second side end of device 1.

In this embodiment of the process, the tubular elements of the second plurality of tubular elements 12, 14 can be configured to release equal portions of the second dosage of water over the respective side regions of conveyor 5. For example, the second dosage of water can comprise two 5% to 12.5% dosage portions released on each side of conveyor 5 and, preferably, the second dosage of water comprises two 10% dosage portions released on each side of conveyor 5.

In this process, the hot products cooled by means of device 1 are preferably iron ore pellets. However, other hot products such as sintered briquettes and other agglomerates can also be cooled by the process of this invention.

In addition, the total dosage of water added in the process comprises the first and second dosages of water and can be from 1 to 7% of the mass of hot products to be cooled.

Comparative Tests

From tests performed with the device and the process according to this invention, the moisture in hot products has a dominant effect in inhibiting particulate emission.

Figure 2:
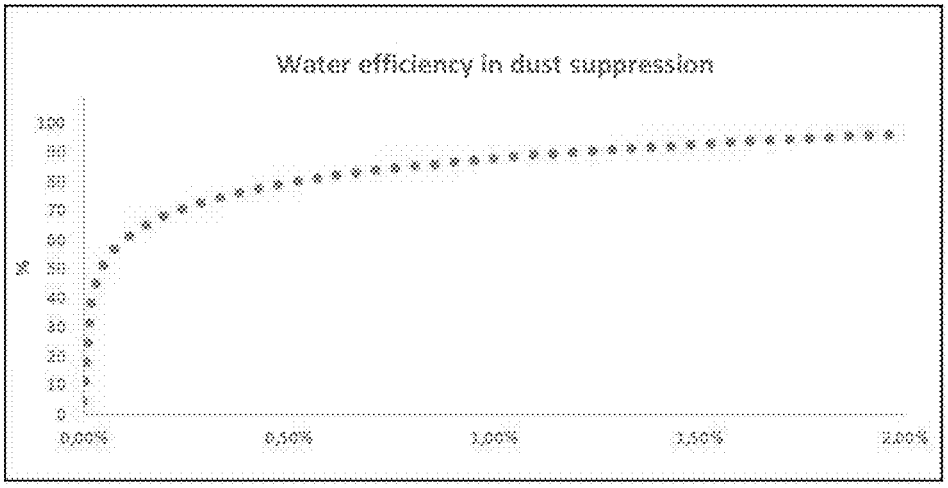
FIG. 2—graph of results of water efficiency in particulate emission inhibition in relation to moisture content of hot products.

As shown in FIG. 2, moistures greater than 1% generate particulate emission inhibition efficiencies above 90%, thereby enabling the use of smaller amounts of emission inhibitors.

Figure 3:
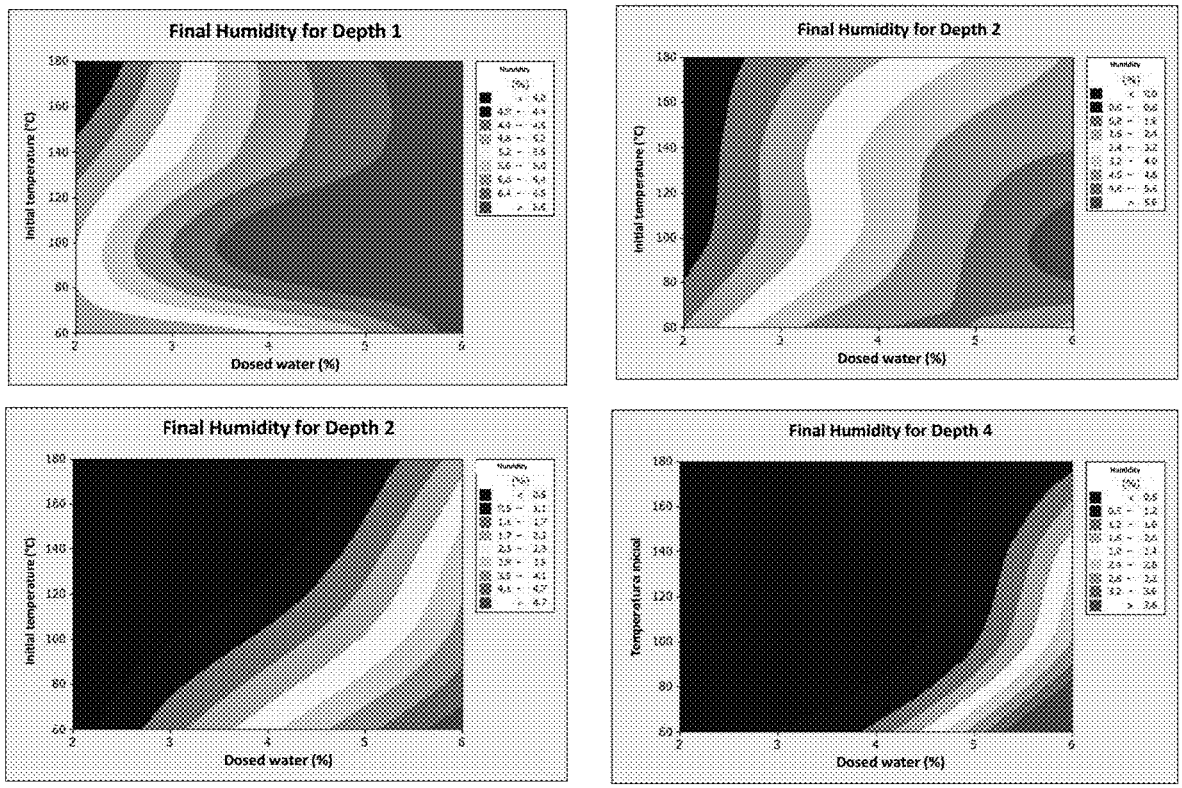
FIG. 3—graphs of final moisture results at various depths of hot material as a function of the initial temperature of the hot products and the amount of water dosed through a cooling process with exclusively superficial water release.

In addition, as illustrated in FIG. 3, it has been found that processes in which water release occurs exclusively superficially are inefficient for cooling and wetting all layers of material disposed on conveyors.

From FIG. 3, it is noted that, considering the 4% water dosage and the initial hot material temperature of 160° C. in a surface cooling process, humidification in the third and fourth layers would be lower than 0.5%, thus not having a high efficiency in the suppression of particulate emissions. In addition, considering an initial hot material temperature of 160° C., humidification above 1% in the third and fourth hot material layers would be achieved only with dosed water amounts above 5%.

In order to overcome the above problems, device 1 allows water to be released over the hot products superficially and laterally, making it possible to efficiently humidify and cool the various layers of these products arranged on conveyor 5.

Figure 4:
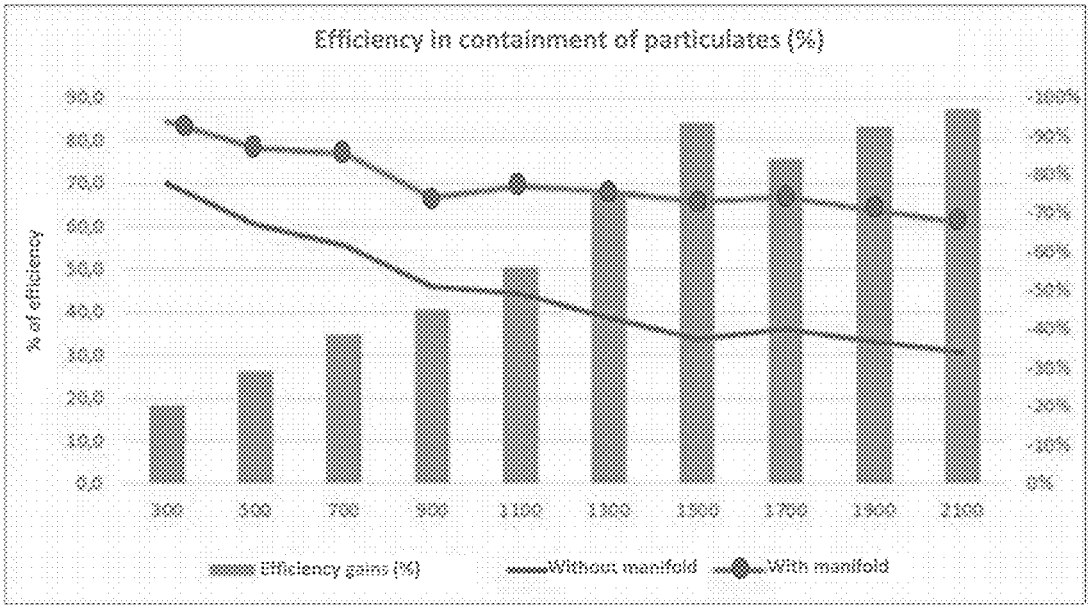
FIG. 4—graph of results of efficiency in particulate containment by the conventional processes employed in the state of the art (surface water application) and using the device (manifold) to inhibit particulate emission by cooling displaceable hot products using a conveyor (application of water on sides and surface)

FIG. 4 presents laboratory test results to verify particle containment efficiency using device 1 (orange line in the graph) and using conventional devices of the state of the art (blue line), that is, which perform the cooling only superficially. In these tests a total water dosage of 2% was used and the initial temperature of the hot products was 140° C.

It can be noted that as the conveyor receives more load (values in t/h expressed on the abscissa axis) and, therefore, with a thicker bed of hot products on the conveyor, there is greater difficulty in water penetration, decreasing bed wetting and hence the efficiency of emission control, as expected.

However, the use of device 1 advantageously enables a significantly lower reduction in particulate emission efficiency when compared to situations in which the device is not used. This can be verified by the efficiency gain values (values expressed in gray bars in relation to the secondary ordinate axis of FIG. 4).

For example, for the 2% dosage employed and for 300 t/h load values, the particulate emission efficiency when using device 1 would be 20% better than not using the device. However, for a 900 t/h load, for example, the use of device 1 has a gain of approximately 45% in emission control efficiency, increasing from 45.9% when device 1 is not used to 66.7% when using device 1.

It is found that for load values between 1500 and 2100 t/h, the use of device 1 enables efficiency gains of greater than 85% compared to situations when the device is not used. For example, for a 2100 t/h load, the use of device 1 achieves an efficiency gain close to 100%.

EXAMPLE 1

In order to verify the humidification in the various layers of hot product arranged on the conveyor, laboratory tests were performed by varying the dosages of water along a cross section of the conveyor according to the bed height of the hot product.

In the three tests of Example 1, a mass of 34 kg of pellets heated to 160° C. was used. The bed formed by the pellets was 15 cm deep and the total dosage of water applied was 4% of the pellet mass. Interestingly, the 4% amount corresponds to 4% of 34 kg. That is, 1,360 grams of water were applied.

In the first test, the results of which are presented in Table 1, 1, 360 grams were applied in a single position, in the central region of the conveyor, on the surface. It is noted that the water barely reached the bottom layers of the bed, generating inefficient cooling and wetting. This first test replicates the surface water application behavior.

TABLE 1

| First Test | | | | |
|---|---|---|---|---|
| Per layer | Post-moistured | Post-drying | Water | % water |
| First layer (g) | 5.890 | 5.490 | 400 | 6.79% |
| Second layer (g) | 10.520 | 10.130 | 390 | 3.71% |
| Third layer (g) | 9.370 | 9.310 | 60 | 0.64% |
| Fourth layer (g) | 9.010 | 9.000 | 10 | 0.11% |

In the second test, the results of which are presented in Table 2, the total water dosage was distributed in a first dosage of 20% released in the central region of the conveyor and a second dosage of 80% released in the side regions, 40% on each side. The humidification generated by this distribution was noticeably inefficient, mainly affecting the second and third layers, positioned in the middle of the pellet bed.

TABLE 2

| Second Test | | | | |
|---|---|---|---|---|
| Per layer | Post-moistured | Post-drying | Water | % water |
| First layer (g) | 4.800 | 4.750 | 50 | 1.04% |
| Second layer (g) | 9.210 | 9.170 | 40 | 0.43% |
| Third layer (g) | 9.220 | 9.180 | 40 | 0.43% |
| Fourth layer (g) | 11.960 | 11.290 | 670 | 5.60% |

In the third test, the results of which are presented in Table 3, the total water dosage was distributed in a first dosage of 80% superficially released in the central region of the conveyor and a second dosage of 20% released in the side regions of the conveyor, 10% on each side. These releases replicate, respectively, the water applications by tubular elements 10*a* and 10*b* (in the central region) and tubular elements 12 and 14 (in the side regions) of device 1.

The humidification generated by this distribution proved to be efficient and even the moisture of the third layer was close to 1% and therefore suitable for inhibiting particulate emission.

TABLE 3

| Third Test | | | | |
|---|---|---|---|---|
| Per layer | Post-moistured | Post-drying | Water | % water |
| First layer (g) | 6.510 | 6.110 | 400 | 6.14% |
| Second layer (g) | 9.540 | 9.180 | 360 | 3.77% |
| Third layer (g) | 8.430 | 8.360 | 70 | 0.83% |
| Fourth layer (g) | 10.280 | 9.930 | 350 | 3.40% |

It can be noted that the dosage distribution of the water used in the third test allowed, in addition to efficient humidification, excellent temperature control, as the temperatures in the middle and bottom of the conveyor were substantially close. The water dosage distribution of the third test allowed homogeneous moisture and temperature distributions in all pellet layers.

EXAMPLE 2

It must be noted that, in the environment, other factors influence the emission result and the most appropriate results are those of measurements that are performed near the points where device 1 is installed.

For example, the various activities that influence the result of the particulate emission meter at the stockyards include pile emissions, stacking events, recovery events, wind fence cleaning, precipitator unloading, silo cleaning, nozzle clogging, higher dosages of water in certain periods, among others.

Figure 5:
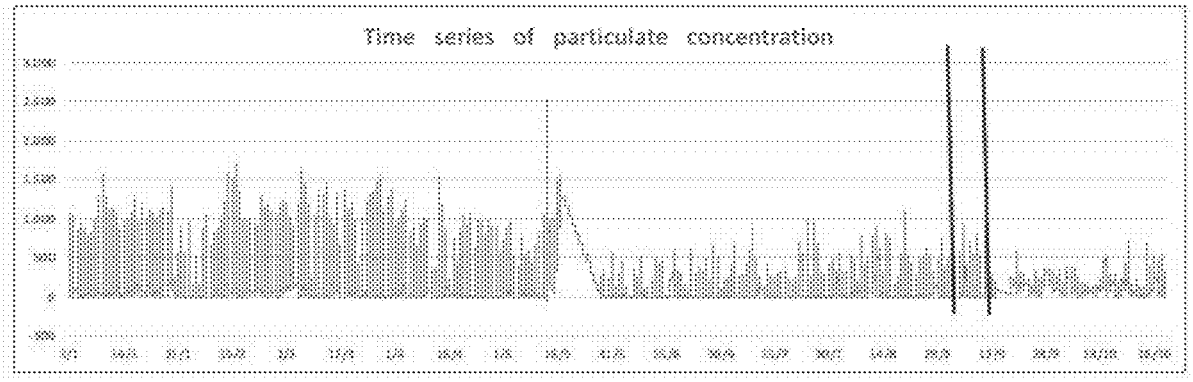
FIG. 5—graph of a time series of particulate concentration values.

FIG. 5 presents a time series of particulate concentration values, measured on an internal particulate monitoring network before and after the inclusion of devices 1 on conveyors 5 located in these stockyards. The inclusion period of these devices 1 is identified by the red vertical lines. It is possible to verify a considerable decrease of the particulate concentration after the insertion of devices 1 in conveyors 5 of the analyzed stockyards.

In view of the examples shown above, it is possible to prove that the device and process for inhibiting particulate emission by cooling of displaceable hot products using a conveyor have unexpected advantages, such as efficient humidification in all layers of hot product using low water consumption and a more homogeneous temperature distribution in these layers. In this regard, it was also verified that the moisture levels that were reached in all layers allow the inhibition of particulate emissions.

The description of the object of this invention must be considered only as a possible embodiment (or embodiments), and any particular characteristics introduced therein must be understood only as being written for ease of understanding. Thus, they cannot in any way be construed as limiting the invention, which is limited to the scope of the following claims.

The invention claimed is:

1. A device for inhibiting particulate emission by cooling of displaceable hot products using a conveyor comprising:

a first plurality of tubular elements configured to release a first dosage of water over hot products;

a second plurality of tubular elements configured to release a second dosage of water over hot products;

wherein the first dosage released by the first plurality of tubular elements is greater than the second dosage released by the second plurality of tubular elements, wherein the second plurality of tubular elements comprises a tubular element disposed at a first side end of the device and another tubular element disposed at a second side end of the device, and wherein tubular elements of the second plurality of tubular elements release equal dosages of water over respective side regions of the conveyor.

2. The device according to claim 1, wherein each tubular element of the first and second pluralities of tubular elements comprises a valve; and wherein the first plurality of tubular elements comprises two to four tubular elements, and is configured to release the first dosage of water over a central region of the conveyor in a direction against a flow of hot products.

3. The device according to claim 1, wherein the first plurality of tubular elements is arranged in a central region of the device.

4. The device according to claim 1, wherein each tubular element of the first plurality of tubular elements comprises a duck nozzle.

5. The device according to claim 1, wherein the second plurality of tubular elements comprises two to four tubular elements, and is configured to release the second dosage of water on the side regions of the conveyor.

6. A process for inhibiting particulate emission by cooling displaceable hot products by a conveyor using a device as defined in claim 1, wherein the device is disposed in a position transverse to a direction of travel of the conveyor, the process comprising:

releasing the first dosage of water over the hot products by the first plurality of tubular elements; and releasing the second dosage of water over the hot products by the second plurality of tubular elements; and wherein the first dosage released by the first plurality of tubular elements is greater than the second dosage released by the second plurality of tubular elements.

7. The process according to claim 6, wherein the releasing of the first dosage of water and the releasing of the second dosage of water are concomitant.

8. The process according to claim 6, wherein the first dosage of water is from 75 to 90% of a total dosage of water and the second dosage of water is from 10 to 25% of the total dosage of water.

9. The process according to claim 6, wherein each tubular element of the first and second pluralities of tubular elements comprises a valve; and wherein the first dosage of water is released over a central region of the conveyor in a direction against a flow of the hot products by the first plurality of tubular elements.

10. The process according to claim 6, wherein the second dosage of water is released on the side regions of the conveyor by the second plurality of tubular elements.

11. The process according to claim 8, wherein the first dosage is fractionated into a 60% portion of the total dosage of water, released by the tubular element located in a center of the device, and into two 10% portions of the total dosage of water, released by each tubular element adjacent to a center tubular element, and/or the second dosage of water comprises two 5% to 12.5% dosage portions released on each side of the conveyor.

12. The process according to claim 6, wherein the hot products are iron ore pellets.

13. The process according to claim 6, wherein a total dosage of water added comprises the first and second dosages of water and is from 1 to 7% of a mass of hot products.

14. The process according to claim 6, wherein the first dosage of water is 80% and the second dosage of water is 20% of a total dosage of water.

15. The process according to claim 14, wherein the second dosage of water comprises two 10% dosage portions released by each tubular element of the second plurality of tubular elements on each side of the conveyor.

16. The device of claim 1, wherein the first plurality of tubular elements comprises three tubular elements, and wherein the second plurality of tubular elements comprises two tubular elements.

* * * * *